United States Patent [19]

Giflo

[11] 4,294,613

[45] Oct. 13, 1981

[54] ACID RESISTANT, HIGH-STRENGTH STEEL SUITABLE FOR POLISHING

[76] Inventor: Henrik Giflo, III Ujitok u.5, 3532 Miskolc, Hungary

[21] Appl. No.: 54,526

[22] Filed: Jul. 3, 1979

[51] Int. Cl.[3] ..... C22C 38/06

[52] U.S. Cl. ..... 75/124; 428/687

[58] Field of Search ..... 75/124 R, 124 B, 124 BA, 75/124 BB, 124 BC, 124 BD, 124 BE, 124 BF, 124 C, 124 CA, 124 CB, 124 CC, 124 CD, 124 CE, 124 E, 124 EA, 124 EB, 124 EC, 124 ED, 124 EE, 124 EF, 124 F, 124 FA, 124 FB, 124 FC, 124 FD, 124 FE; 428/687

[56] References Cited

U.S. PATENT DOCUMENTS

| | | | |
|---|---|---|---|
| 2,763,543 | 9/1956 | Wagner | 75/122 |
| 2,797,993 | 7/1957 | Tanczyn | 75/125 |
| 2,848,323 | 8/1958 | Harris et al. | 75/124 |
| 3,166,406 | 1/1965 | Floreen et al. | 75/124 FE |
| 3,598,574 | 8/1971 | Ito et al. | 75/128 E |
| 3,719,474 | 3/1973 | Bieber et al. | 75/124 C |
| 3,778,255 | 11/1973 | Ototani et al. | 75/126 C |
| 3,989,514 | 11/1976 | Fujioka et al. | 75/124 FB |
| 4,010,049 | 3/1977 | Rarey | 75/126 D |
| 4,043,807 | 8/1977 | Kirman | 75/124 BC |
| 4,059,440 | 11/1977 | Takemura et al. | 75/126 C |
| 4,153,454 | 5/1979 | Emi et al. | 75/124 B |
| 4,155,752 | 5/1979 | Oppenheim et al. | 75/124 FB |

FOREIGN PATENT DOCUMENTS 2180117 11/1973 France .

OTHER PUBLICATIONS

Metals Handbook, 8th ed., vol. 2, 1964, pp. 371–386.

*Primary Examiner*—L. Dewayne Rutledge
*Assistant Examiner*—John P. Sheehan
*Attorney, Agent, or Firm*—Beveridge, DeGrandi, Kline & Lunsford

[57] ABSTRACT

A high strength steel, suitable for polishing and acid-resistant cohesion, comprising besides iron and the usual residual elements, at most 2% (by weight) of C, at most 1% (by weight) of Si, at most 5% (by weight) of Mn, at most 15% (by weight) of Cr, at most 12% (by weight) of Ni, at most 4% (by weight) of Cu, at most 3% (by weight) of Mo, at least 0.005% (by weight) of N, 0.005% to 0.25% (by weight) of Zr and/or Be, 0.001 to 0.2% (by weight) of Al, 0.04 to 1.5% (by weight) of Nb and/or V, at least 0.001% (by weight) of Ca and at least 0.001% (by weight) of B and/or Ce.

4 Claims, No Drawings

ACID RESISTANT, HIGH-STRENGTH STEEL SUITABLE FOR POLISHING

This invention relates to an acid resistant steel suitable for polishing that exhibits a good weldability up to a well-defined carbon content and high strength, even in the rolled state, and even without hardening and tempering treatment or without cold deformation; a steel particularly suited for construction of machines and installations intended for the refrigeration, food and meat industries, for making forms and junction points or assembly and fastening nodes for the building industry, and machine elements for making vehicles and high-strength connecting elements, where the material undergoes great mechanical stresses and has to exhibit a corrosion-resistant surface and able to meet well determined requirements on the health level.

The constant growth of the needs of society for food, shelter and other necessities of local groups calls for mass production of the products previously mentioned or makes it necessary to transform them intensively on an industrial scale for mass consumption.

This mass production entails the construction and fabrication of modern high output machines and installations which make it necessary to produce raw materials suited to present needs.

Machines and installations of the food industries, including meat lines and slaughterhouses, must not only meet the stresses that usually occur in operation but must also meet strict health regulations with regard to surface quality and resistance to corrosion, the materials used in their fabrication consequently having to exhibit special properties.

In the case of the refrigeration industry the materials must meet similar requirements.

In the case of large complexes of the building industry, one of the essential requirements relates to the quality of the inside surfaces of walls which have to be perfectly smooth. This degree of finish is especially a function of the quality of the surfaces and corrosion resistance of the forms.

The mechanical strength and corrosion resistance of the assembly and fastening nodes and the junction elements intended to transmit the forces of the prefabricated plates essentially govern the life of the structures made with these elements. A high-strength steel that is weldable and acid-resistant is essential in this case.

To meet the requirements of hygiene, aesthetics, and surface quality, there is every advantage in using a high-strength steel exhibiting a good weldability, sufficient resistance to wear and acids and which, while entailing minimal production costs, can have wide industrial application and at a high level and in all their complexity, meet the above mentioned demands.

Grades of steel are known that exhibit a good weldability up to a well defined carbon content and a ferritic, martensitic or austenitic state which is a function of the alloy elements and which governs their resistance and field of applications of these grades. There are in the first place ferritic and austenitic steels that are weldable and acid-resistant which are used to meet the above mentioned needs.

The chemical composition of these grades of steel contain at least 12% by weight of Cr, but also at least 8% of Ni and/or Mn, in regard to austenitic steels. To make it possible to obtain a reduction of intercrystalline corrosion or local or spot corrosion, these grades of steel contain at least 1% Mo and a proportion of Ti or Nb that corresponds to 5–8 times their carbon content.

In regard to the mechanical properties of these steels, the maximal tensile strength is between about 300 to 500 $N/mm^2$ for the most important weldable ferritic and austenitic steel grades which do not exceed even 50% of the apparent elastic limit.

Use of these grades of steel for various constructions is not economical in this state, given their low strength and the high costs incurred, and it must be ruled out for mass production, except where it is essential because of health regulations or from the viewpoint of corrosion resistance.

A valuable increase in the strength of these grades of steel can be obtained by a suitable cold deformation. This property is also used to advantage in the case of other acid-resistant grades of steel for making the structures mentioned above. Increases in the mechanical strength of these acid-resistant steels is reflected by a reduction, which compensates for specific cost increases of the raw materials and further makes it possible to obtain other technical advantages, during the fabrication of constructions, for example, a better appearance from the aesthetic viewpoint and a reduction of maintenance costs.

Although the corrosion resistance of acid-resistant steels, which were cited above, corresponds to the desired end, it still remains that their mechanical strength can be increased only by a costly cold deformation. Consequently, in practice these steels are used only for fabricating flat shapes. With acid-resistant steels whose mechanical strength has been increased by cold deformation, general application of welding is limited by reduction of the strength in the thermally affected zone and it is not always entirely possible to obtain a perfect surface from the viewpoint of health requirements.

Known steels, exhibiting a good weldability and sufficient acid resistance therefore have a slight mechanical strength and mediocre aptitude for polishing.

The object of this invention is to make an acid-resistant steel exhibiting a good weldability, which further offers a higher mechanical strength and a better aptitude for polishing than grades of steel known so far, the strength of this steel being high even without hardening and tempering treatment and without cold deformation. This invention therefore has for its object the making of a grade of steel which, because it has the properties mentioned above, is particularly suited for construction of machines and installations undergoing great mechanical stresses, which must be resistant to wear and meet health regulations or other products that have to exhibit a good surface quality.

In the first place there are involved machines and installations for the refrigeration and food products industry, the meat industry, forms and assembly and fastening nodes for dwelling units, construction elements for making vehicles, energy generating machines, high strength junction and connection elements, etc.

This invention makes it possible to achieve the stated objective because the elaborated steel contains, besides iron at most 2.00% (by weight) of C, at most 1.00% (by weight) of Si, at most 5.00% (by weight) of Mn, at least 5.00% (by weight) preferably at least 12%, of Cr at most 12.00% (by weight) of Ni, at most 4.00% (by weight) of Cu, at most 3.00% (by weight) of Mo, at least 0.005% (by weight) of N, 0.005 to 0.25% (by weight) of Zr, and/or Be, 0.001 to 0.20% (by weight) of Al, 0.04 to 1.50% (by weight) of Nb and/or V, at least 0.001% (by weight) of Ca, and at least 0.001% (by weight) of B and/or Ce.

A preferred composition of the steels according to the invention is the following:

| | | | |
|---|---|---|---|
| C | 0.04–0.5% | Mo | 0.05–0.5% |
| Mn | 0.1–1% | Cu | 0.01–0.5% |
| Si | 0.1–1% | Zr | 0.005–0.25% |
| S | 0.01–0.10% | Nb | 0.04–0.1% |
| Cr | 5–15% | V | 0.04–0.1% |
| Ni | 0.05–1% | Al | 0.001–0.02% |
| N | 0.005–0.06% | B | 0.001–0.01% |
| | | Ca | 0.001—0.01% |

As may be seen from the foregoing, the broad range of composition of the invention, in addition to iron and usual trace elements is as follows:

| | | | |
|---|---|---|---|
| C | 0.04–2% | Mo | 0.05–3% |
| Mn | 0.1–5% | Cu | 0.01–4% |
| Si | 0.1–1% | Zr | 0.005–0.25% |
| S | 0.01–0.10% | Nb | 0.04–1.5% |
| Cr | 5–15% | V | 0.04–1.5% |
| Ni | 0.05–11% | Al | 0.001–0.2% |
| | | B | 0.001–0.01% |
| N | 0.005–0.06% | Ca | 0.001–0.01% |

Some of alloy elements, when they are in the ratio according to this invention, form complex metal compounds which in part, produce even in the pouring stage, active seed of critical dimension, which are also, in part, put in solutions in the interstices thus creating a pre-stress in the iron lattice and thus increasing the number of lattice defects and which, in part, cause metal precipitations having a great shearing strength, which at the same time increase and stabilize in a coherent way the internal stress of the base material lattice. Other alloying elements or alloyed elements are enriched at the grain boundaries, which retards the process of formation of non-coherent precipitations which occurs at these sites, thereby prevents the enrichment of these precipitations along the grain boundaries and thus leads to an increase of the strength of the grain boundaries.

The increase in the number of seeds of critical dimension entails a great increase in the aptitude for crystallization presented by the casting, a reduction in solidification time and in the coarseness of primary grain boundaries and a limitation in the possible formation of intermetallic enrichments.

The advantageous properties and ratio of the components create, in the alloying system according to this invention, such thermodynamic, kinetic and seeding conditions, during the solution, solidification, recrystallization and hot deformation steps, that the arrangement of the components on being put in interstitial solution, the amount of these components, and the number and degree of stress of the lattices thus put under prestress are clearly increased.

Thanks to the increase in the number of lattices exhibiting an interstitial pre-stress and their degree of stress, the number of metallurgically produced dislocations which promote and govern the formation and dispersion of the metal precipitations is greatly increased, which notably increases the effectiveness of the anchoring or fostering function of the precipitations during the dislocation front movement that the changes trigger.

The elements, encased and enriched in the grain boundary defects, make it possible greatly to reduce the diffusion of neighboring metal atoms, retard the formation of non-coherent seeds and finally reduce the number of seeds that are formed. Thus, there is prevented the establishment, along the grain boundaries, of a zone exhibiting lesser mechanical strength and creep strength as a result of starting from alloyed elements or precipitations. A premature bursting of the grain boundaries as a result of dislocations is further retarded, and the possibilities of breaking elongation and shrinkage by creep are improved which brings a notable improvement of plasticity, aptitude for cold and hot deformation, and the mechanical strength of the steel.

The components according to this invention or their advantageous ratio thus automatically assure excellent metallurgical quality of the steel during its elaboration and make it possible to develop, even without hardening and tempering treatment and without cold deformation, effective reenforcement mechanisms whose action entails a multiplication of the mechanical strength and endurance limit or fatigue strength of the steel.

The chemical composition of the steel according to this invention also comprises alloy elements that improve by about 40% the polishing and surface quality of the steel, and notably increase its aptitude for hot deformation and its cold plasticity.

With a suitable carbon content and a suitable specific heat addition, the acid-resistant steel, according to the invention, exhibits a good weldability. The properties of the zone thermally affected by the welding correspond to the properties of the base material.

Making of the steel according to the invention can occur under the same conditions as those of standard acid-resistant steels, and with an identical technology, this steel can be hot shaped into any metallurgical shapes, and it can be mass produced without special installations. It exhibits excellent mechanical properties, even without hardening and tempering treatment and without cold deformation, which consequently makes it possible to continue applying standard transformation and joining technologies for making products from the new material.

Since the costs of fabricating products made with the steel according to this invention do not exceed the average level, the benefit obtained on the economic plane from the technical advantages offered by the steel according to this invention is practically unaffected by the fabrication and use of the new base material. The above mentioned advantages cover, among others, the following areas: energy saving, weight reduction, corrosion resistance, reduction of maintenance costs, etc.

Because of the increase in the strength of the steel according to the present invention, which amounts to several times that of known steels, it becomes possible to lighten the construction of the products mentioned in the introduction to this patent application, so that the cost of materials of the products made with the new steel does not exceed that of products made with standard grades of steel, their aesthetical appearance, life and other properties already mentioned being in turn notably superior to those of standard products.

This invention will be better understood from the detailed description of several modes of making the steel, given as non-limiting examples, and of its properties.

EXAMPLE I

By way of example, there are given to charges belonging to the weldable ferritic field of steel according to this invention. In the examples cited, charge 1 was produced in a 10-ton arc furnace and solidified in the form of 1.5-ton ingots. From these ingots were produced, by rolling, without skinning, square ingots exhibiting an edge length of 120 mm, which were transformed, under normal conditions, into coiled steel rods with a diameter of 6.4 and 15.5 which were then air cooled.

TABLE 1-continued

| | | | | | | | | |
|---|---|---|---|---|---|---|---|---|
| 2 | 0.095 | 0.77 | 0.165 | 0.024 | 0.017 | 12.93 | 0.105 | 0.10 |

| | Cu | Zr | Nb | V | Al | B | N | Ca |
|---|---|---|---|---|---|---|---|---|
| 1 | 0.27 | 0.027 | 0.093 | 0.035 | 0.12 | 0.0018 | 0.030 | 0.0037 |
| 2 | 0.25 | 0.030 | 0.056 | 0.08 | 0.08 | 0.0024 | 0.043 | 0.0041 |

TABLE 2

1.2 Mechanical properties

| Designation and Unit of Measure | | Rolled[1] | | 400° C.[2] | | 800° C.[3] | | 1250° C.[4] | |
|---|---|---|---|---|---|---|---|---|---|
| | | 1. | 2. | 1. | 2. | 1. | 2. | 1. | 2. |
| $Rp^{0.002}$ | $N/mm^2$ | 900 | 990 | 1112 | 1262 | 520 | 690 | 1010 | 1060 |
| Rm | $N/mm^2$ | 1116 | 1360 | 1288 | 1330 | 606 | 725 | 1331 | 1212 |
| $A_{5d}$ | % | 10 | 11 | 16.2 | 15 | 33.4 | 20 | 14.7 | 12 |
| Z | % | 45.5 | 42 | 54.4 | 64 | 70.2 | 67 | 47.8 | 43.4 |

[1]rolled state without heat treatment
[2]kept hot, at 400° C., for 90 minutes, then air cooled
[3]kept hot, at 800° C., for 90 minutes, then air cooled
[4]kept hot, at 1250° C., for 45 minutes, then air cooled
designates elastic limit, Rm the breaking load, $A_{5d}$ elongation, Z reduction of are Charge 2 was melted in a 65-ton arc furnace and then refined in a metallurgical installation comprising a ladle and poured into 6-ton ingot moulds having a square shape. The 6-ton ingots were forged into square ingots exhibiting an edge length of 280 mm, which were then transformed by rolling, after a surface cleaning and under normal conditions, into steel rods with a 20-mm diameter which were air cooled on coolers. The results of the controls and tests made on the materials appear in the following tables.

The charges are prepared by usual metallurgical methods consisting in melting the iron charge in the furnace above indicated, in analysing the composition of the melt and in adding eventually the necessary supplementary ingredients in order to balance the composition. The molten charge is overheated at a temperature about 145° F. in excess of the temperature of the casting and then poured into refining ladles. The different powder additives as indicated in table 1 are respectively added in order to have the final composition as indicated in table 1. The content of the ladles is then poured in shells or in a continuous casting installation as indicated above.

The method and devices used are namely described by L. Bäcker and P. Gosselin in Journal of Metal, May 1971 No. 23 p. 16 to p. 27.

TABLE 1

1.1 Chemical composition of charges

| Charge | Chemical composition in % (by weight) | | | | | | | |
|---|---|---|---|---|---|---|---|---|
| | C | Mn | Si | P | S | Cr | Ni | Mo |
| 1 | 0.12 | 0.53 | 0.69 | 0.018 | 0.026 | 13.4 | 0.21 | 0.18 |

1.3 GRAIN COARSENESS

Samples were taken from charge 1 annealed for 60 minutes and checked, the austenite grain coarseness of these samples was determined. The checking was made by ASTM standards by the comparison methods whose results appear in table 3:

TABLE 3

| Annealing temperature °C. | Granulometry index |
|---|---|
| 950 | 12–11 |
| 1000 | 11 |
| 1050 | 11–10 |
| 1100 | 11–10 |
| 1150 | 10 |
| 1200 | 10 |

1.4 CORROSION TEST

Considering the use of the steel in the refrigeration, food product and meat industries, including slaughterhouses, charge 1 was checked for corrosion resistance. An austenitic acid-resistant steel, whose chemical composition appears in table 4, was used as the basis for comparison.

TABLE 4

| Chemical composition in % (by weight) Symbol | | | | | | | | |
|---|---|---|---|---|---|---|---|---|
| C | Mn | Si | P | S | Cr | Ni | Mo | Nb |
| 0.11 | 1.62 | 0.35 | 0.031 | 0.010 | 17.54 | 9.07 | 1.36 | 0.63 |

The results of the checking testing are summarized in Table 5.

TABLE 5

| | Measured iron content of corrosive agent | | | | | |
|---|---|---|---|---|---|---|
| | Average iron content | | Dispersion | | Relative Dispersion | |
| Corrosive Agent | Charge 1 | Steel Used as basis of comparison | Charge 1 | Steel Used as basis of comparison | Charge 1 | Steel Used as basis of comparison |
| Corrosive liquid coming from meat industry, 40° C. 10 days | 8.86 | 6.68 | 6.616 | 0.418 | 6.952 | 2.257 |
| Lard 40° C., 10 days | 18.43 | 55.18 | 0.318 | 1.642 | 1.725 | 2.975 |
| Sodium hypochlorite | 76.09 | 24.92 | 2.22 | 0.893 | 2.917 | 3.583 |

TABLE 5-continued

| Corrosive Agent | Measured iron content of corrosive agent | | | | | |
|---|---|---|---|---|---|---|
| | Average iron content | | Dispersion | | Relative Dispersion | |
| | Charge 1 | Steel Used as basis of comparison | Charge 1 | Steel Used as basis of comparison | Charge 1 | Steel Used as basis of comparison |
| 40° C., 10 days | | | | | | |

Table 6 shows the results of an examination of the samples kept for 10 days at 40° C. in a place whose relative vapor content was 96%.

TABLE 6

| Weight variation caused | | | | | |
|---|---|---|---|---|---|
| Average $10^{-4}$g/ sample | | Dispersion $10^{-4}$g/ sample | | Relative dispersion % | |
| Charge 1 | Steel used as basis of comparison | Charge 1 | Steel used as basis of comparison | Charge 1 | Steel used as basis of comparison |
| +5 | +61 | ±27 | ±107 | 540 | 174 |

During tests made in a sodium hypochlorite solution there were found on the samples used as a basis of comparison corrosion spots going through 75% of the shape, spots that rule out this steel as construction material, despite the slight weight loss. No corrosion spot occurred on the samples from charge 1.

I claim:

1. A high strength steel, suitable for polishing and acid-resistant cohesion, consisting essentially of, besides iron and the usual residual elements, 0.04 to 2% (by weight) of C, 0.1 to 1% (by weight) of Si, 0.1 to 5% (by weight) of Mn, at least 5% (by weight) of Cr, at most 12% (by weight) of Ni, 0.01 to 4% (by weight) of Cu, 0.05 to 3% (by weight) of Mo, 0.005 to 0.6% (by weight) of N, 0.005 to 0.25% (by weight) of Zr or Be or their mixture, 0.001 to 0.2% (by weight) of Al, 0.04 to 1.5% (by weight) of Nb or V or their mixture, 0.001 to 0.01% (by weight) of Ca and at least 0.001 (by weight) of B or Ce or their mixture.

2. A steel according to claim 1 consisting essentially of besides iron and the usual residual elements, the following components in the indicated proportions:

| | | | |
|---|---|---|---|
| C | 0.04-2% | Mo | 0.05-3% |
| Mn | 0.1-5% | Cu | 0.01-4% |
| Si | 0.1-1% | Zr | 0.005-0.25% |
| S | 0.01-0.10% | Nb | 0.04-1.5% |
| Cr | 5-15% | V | 0.04-1.5% |
| Ni | 0.05-12% | Al | 0.001-0.2% |
| N | 0.005-0.06% | B | 0.001-0.01% |
| | | Ca | 0.001-0.01% |

3. A steel according to claim 1 consisting essentially of besides iron and the usual residual elements, the following components in the indicated proportions:

| | | | |
|---|---|---|---|
| C | 0.04-0.5% | Mo | 0.05-0.5% |
| Mn | 0.1-1% | Cu | 0.01-0.5% |
| Si | 0.1-1% | Zr | 0.005-0.25% |
| S | 0.01-0.10% | Nb | 0.04-0.1% |
| Cr | 5-15% | V | 0.04-0.1% |
| Ni | 0.05-1% | Al | 0.001-0.02% |
| N | 0.005-0.06% | B | 0.001-0.01% |
| | | Ca | 0.001-0.01% |

4. A highly polished steel surface formed from the composition of claim 1.

* * * * *

UNITED STATES PATENT AND TRADEMARK OFFICE

CERTIFICATE OF CORRECTION

PATENT NO. : 4,294,613

DATED : October 13, 1981

INVENTOR(S) : Henrik Giflo

It is certified that error appears in the above—identified patent and that said Letters Patent is hereby corrected as shown below:

On the Title Page, Item [22], "July 3, 1979" should read

--- July 2, 1979 ---.

Signed and Sealed this

*Sixteenth* Day of *February 1982*

[SEAL]

*Attest:*

GERALD J. MOSSINGHOFF

*Attesting Officer*

*Commissioner of Patents and Trademarks*